US005095892A

United States Patent [19]

Tsumura

[11] Patent Number: 5,095,892

[45] Date of Patent: Mar. 17, 1992

[54] BRUSH FOR HAIR AND BODY

[76] Inventor: Takashi Tsumura, 9-1-7, Akasaka, Minato-ku, Tokyo, Japan

[21] Appl. No.: 467,345

[22] Filed: Jan. 22, 1990

Related U.S. Application Data

[63] Continuation of Ser. No. 151,604, Feb. 22, 1988, abandoned.

[51] Int. Cl.[5] ..... A61H 7/00

[52] U.S. Cl. ..... 128/62 R; 128/61

[58] Field of Search ..... 128/62 R, 61, 62; 15/110, 159 A, 159 R, 186, 191 R

[56] References Cited

U.S. PATENT DOCUMENTS

| | | | |
|---|---|---|---|
| 998,328 | 7/1911 | Czinjak | 178/62 R |
| 2,138,872 | 6/1936 | Morogg | 15/186 |
| 2,482,928 | 9/1949 | Neff et al. | 128/62 R |
| 4,114,222 | 9/1978 | Serediuk | 15/186 |

FOREIGN PATENT DOCUMENTS

| | | | |
|---|---|---|---|
| 166134 | 6/1950 | Austria | 15/186 |
| 334840 | 3/1921 | Fed. Rep. of Germany | 128/62 P |
| 815072 | 9/1951 | Fed. Rep. of Germany | 128/62 R |
| 969007 | 12/1950 | France | 128/62 R |
| 8/1982 | 2/1933 | Japan . | |
| 296639 | 9/1928 | United Kingdom | 128/62 R |
| 622532 | 5/1949 | United Kingdom | 15/186 |

*Primary Examiner*—Edgar S. Burr
*Assistant Examiner*—Lisa E. Malvaso
*Attorney, Agent, or Firm*—Wenderoth, Lind & Ponack

[57] ABSTRACT

A brush for massaging and patting skin comprising wooden base and having a concave. A bristle plant elastic base with many orifices at all around of the upper face thereof and fixed permanently to or fit repeatedly in the concave of the wooden base. And many wooden bristles can replaceably be planted in the orifices of the elastic planted base.

3 Claims, 2 Drawing Sheets

BRUSH FOR HAIR AND BODY

This application is a continuation of now abandoned application Ser. No. 07/151,604 filed on Feb. 22, 1988.

BACKGROUND OF THE INVENTION

The present invention relates generally to a brush for massaging the scalp and body, especially to a brush for massaging the scalp and for brushing hair.

There are many kinds of brushes for just brushing hair. However, there are no brushes for brushing hair and also for massaging the skin.

In conventional brushes, the bristles are made of animal hair, metal or plastic. Therefore, a brush made of animal hair hurts the skin if it is used for massaging the skin, since the ends of animal hair are too sharp. It also hurts and pulls out hair, since the animal hairs are embedded so densly in the brush. And brushes made of metal or plastic cause loss of hair because of static electricity during massaging. Therefore, conventional brushes are useful only for brushing hair. Moreover, as the bristles of conventional brushes are embedded in the brushes themselves, the brushes cannot be repaired when they are broken, which shortens the life of the brushes.

BRIEF SUMMARY OF THE INVENTION

It is an object of the present invention to provide a brush for both hair and body employing replaceable wooden bristles.

It is another object of the present invention to provide a brush usable not only for brushing hair but also for massaging the skin.

The present invention is a brush for massaging and patting the skin comprising a wooden base and having a concavity therein. A bristle holding elastic base with many orifices throughout the upper face thereof and fixed permanently to or fit repeatedly in the concavity of the wooden base is provided. Many wooden bristles can replaceably be held in the orifices of the elastic bristle holding base.

Given that the brush for massaging the skin of the present invention as described above is composed of a bristle holding base and wooden bristles, the brush can be used not only for brushing the hair but also for massaging the skin. And as the bristles of the brush of the present invention are easily replaceable into and out of the orifices of the bristle holding base, bristles can be replaced when they are broken, which lengthens the life of the brush.

The various novel features which characterize the present invention are pointed out with particularity in the claims annexed to and forming a part of this specification. For a better understanding of the invention, its operating advantage, and specific objects attained by its use, reference should be made to the accompanying drawings and descriptive matter in which the preferred embodiments of the invention are illustrated and described. It should be understood that any change within the scope of the claims may be resorted to without departing from the spirit and scope of the invention and without sacrificing any of the advantages thereof.

DETAILED DESCRIPTION OF THE INVENTION

Figure 1:
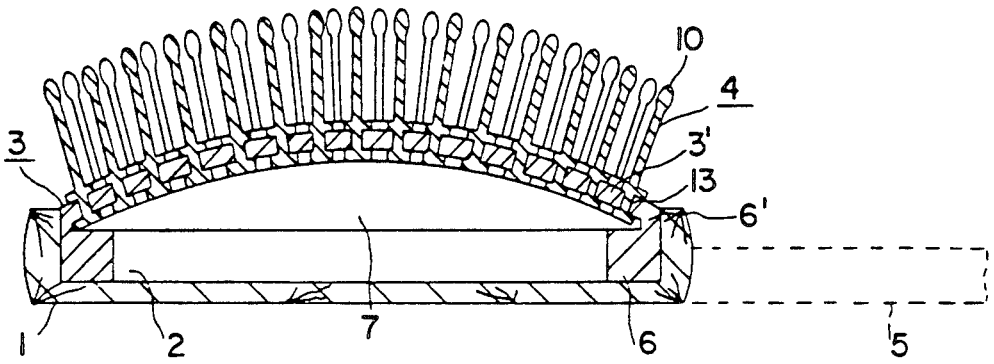
FIG. 1 is a cross-sectional vertical sectional view of an embodiment of the present invention.

A preferred embodiment of the present invention will now be described with reference to the accompanying drawings.

The present invention comprises a base 1 made of wood such as beech and having a concavity 2. A bristle holding base 3 with a plurality of bristle receiving orifices 13 throughout the upper face thereof, which is made of elastic material such as rubber. The bristle holding base 3 is mounted in the concavity 2 of the wooden base 1. A plurality of wooden bristles 4 are removably mounted, one in each orifice 13 of the bristle holding base 3.

The planted part of the lower part of a bristle 4 is formed with a couple of brims or rims 11, 11' and a groove 12, which clutches an orifice 13 of the bristle holding base 3. Thereby, each planted part of the bristles 4 is firmly in each orifice 13 of the bristle holding base 3, when assembled.

Figure 2:
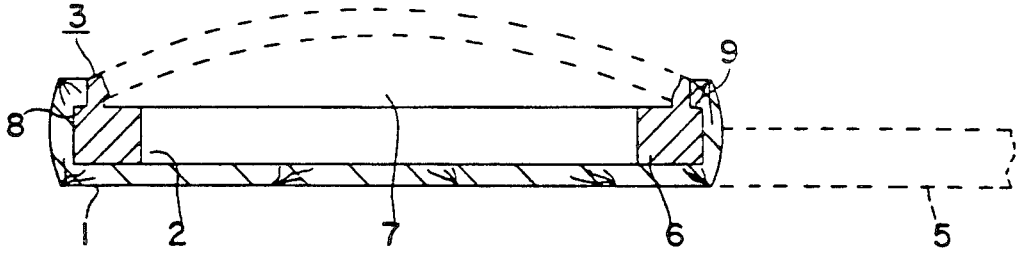
FIGS. 2 and 3 are cross-sectional vertical sectional views of other embodiments, wherein the bristle holding bases are different from the embodiment of FIG. 1.
Figure 3:
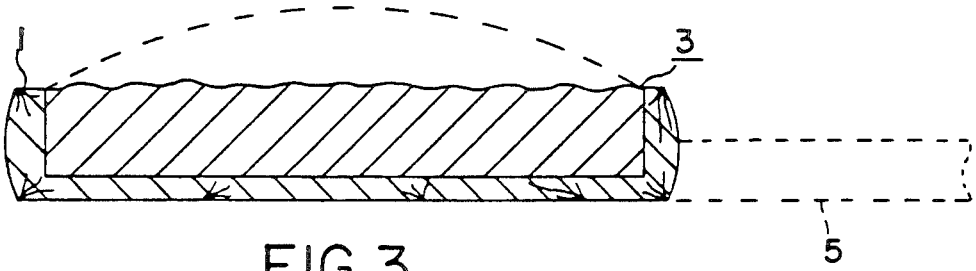
Figure 4:
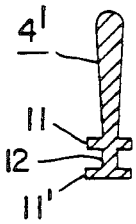
FIGS. 4–7 are side views of bristles of other embodiments.
Figure 6:
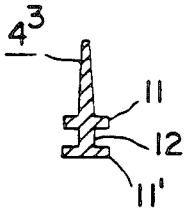
Figure 5:
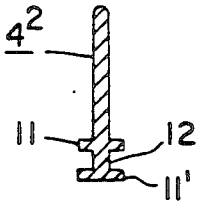
Figure 7:
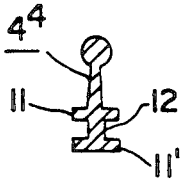

As shown in FIG. 1, the bristle holding base 3 is so formed that the edge which touches to the concavity 2 is an annular thick part 6. The inside of the bristle holding base 3 is formed with a space part 7. Or, as shown in FIG. 3, the bristle holding base 3 may be so formed that it is one solid thing. As shown in FIG. 2, if a suitable brim 8 is formed at the top part of the concavity 2 of the wooden base 1, and also if a convex 9 which fits into the brim 8 is formed at the top part of the annular thick part 6 of the bristle holding base 3, then the bristle holding base 3 is more firmly clutched in the concavity 2. The shape of the bristle 4 is not limited, and the top part of the bristle can be formed as a sphere or as a variety of shapes as shown in FIGS. 4–7. Four different bristle embodiments $4^1$, $4^2$, $4^3$ and $4^4$ are shown in FIGS. 4–7, respectively. The bristle holding base may be so shaped that its entire upper face is suitably carved. And as shown in the dotted line in FIG. 3, the brush of the prevent invention may have a grip 5 which is formed one piece with the wooden base 1.

As the bristles 4 have spherical parts 10 at the top parts or are shaped as the ones shown in FIGS. 4–7, and as the bristles are made of wood, the present invention provides a good brush for not only brushing the hair but also massaging the scalp and body. The brush is especially effective for massaging when the skin is stimulated with the brush by pressing the skin with the top parts of the bristles 4.

The more the brush is used, the softer the tops of the bristles become because of oil from the skin, which is suitable for massaging the skin. And as the bristle holding base itself works as a cushion, it is suitable for brushing and setting hair. The brush is also suitable for patting skin hair, since it protects against generation of loss of hair and helps grow hair by suitable stimulation. Given that the base 1 and bristles 4 are made of wood, such protects against the generation of static electricity. Cleaning of the bristles is easy.

I claim:

1. A brush for the hair and the body, comprising:

a wooden base having a concavity on one face thereof having an inner periphery therearound;

a bristle holding base made of elastic material and mounted in said concavity in said wooden base, and having an annular thick part engaged with the inner periphery of said cavity, a vertically extending piece integral with but thinner than said thick part and extending upwardly therefrom and flexibly connected thereto and a convex bristle holding layer thinner than said thick part integrally joined to said upwardly extending part and having a plurality of bristle receiving orifices over the area of said bristle holding layer, said convex bristle holding layer having a space therebeneath extending into the interior of said annular thick part; and a plurality of bristles made of wood, one removably mounted in each orifice, and each having a spherical element on a free end thereof and a pair of spaced rims at a bristle mounting end, said bristle mounting end extending through a corresponding orifice with said rims engaged with opposite surfaces of said bristle holding layer.

2. A brush as claimed in claim 1 in which said wooden base is made of beech.

3. A brush as claimed in claim 1 in which said bristles are made of beech.

* * * * *